US010668595B2

(12) United States Patent
Sekiya

(10) Patent No.: US 10,668,595 B2
(45) Date of Patent: Jun. 2, 2020

(54) METHOD OF USING LAMINATED DRESSING BOARD

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 177 days.

(21) Appl. No.: 15/880,817

(22) Filed: Jan. 26, 2018

(65) Prior Publication Data

US 2018/0215010 A1 Aug. 2, 2018

(30) Foreign Application Priority Data

Jan. 27, 2017 (JP) ..... 2017-013181

(51) Int. Cl.
*B24B 53/12* (2006.01)
*B24B 7/22* (2006.01)

(52) U.S. Cl.
CPC ..... *B24B 53/12* (2013.01); *B24B 7/228* (2013.01)

(58) Field of Classification Search
CPC ..... B24B 53/12; B24B 7/228; B24D 5/00; B24D 5/02; B28D 5/022; B28D 5/0064
See application file for complete search history.

(56) References Cited

U.S. PATENT DOCUMENTS 9,397,000 B2 * 7/2016 Priewasser ..... H01L 21/78
9,418,908 B2 * 8/2016 Tanaka ..... H01L 22/20
9,627,260 B2 * 4/2017 Sekiya ..... H01L 22/20
10,388,534 B2 * 8/2019 Takenouchi
2011/0124181 A1 * 5/2011 Suzuki ..... B28D 5/0011 438/464
2013/0298744 A1 * 11/2013 Kumazawa ..... B23K 26/0093 83/863

FOREIGN PATENT DOCUMENTS

JP 2006-218571 A 8/2006
JP 2011-083840 A 4/2011
JP 2011083840 A 4/2011

* cited by examiner

*Primary Examiner* — Dung Van Nguyen

(74) *Attorney, Agent, or Firm* — Greer Burns & Crain, Ltd.

(57) ABSTRACT

A method of using a laminated dressing board is provided. In the laminated dressing board, a shape adjustment dressing layer containing first abrasive grains and used for shape adjustment of a cutting blade and a setting dressing layer containing second abrasive grains and used for setting of the shape-adjusted cutting blade are laminated. The method includes a holding step of holding the shape adjustment dressing layer side of the laminated dressing board by a chuck table, a setting dressing step of causing the cutting blade to cut into the laminated dressing board from the setting dressing layer side to form a first groove in the setting dressing layer, and a shape adjustment dressing step of causing the cutting blade to cut into the bottom of the first groove along the first groove to form a second groove in the shape adjustment dressing layer.

8 Claims, 5 Drawing Sheets

METHOD OF USING LAMINATED DRESSING BOARD

BACKGROUND OF THE INVENTION

Field of the Invention

The present invention relates to a method of using a laminated dressing board in which a plurality of dressing boards are laminated in the thickness direction.

Description of the Related Art

In dividing a plate-shaped workpiece represented by a semiconductor wafer into a plurality of chips, for example, a cutting apparatus having an annular cutting blade is used. While the cutting blade rotated at high speed is being made to cut into the workpiece, the cutting blade and the workpiece are moved relative to each other, whereby the workpiece can be cut along the path of movement.

Meanwhile, the above-mentioned cutting blade is formed, for example, by binding abrasive grains of diamond or the like with a binder such as a resin or metal. Prior to cutting of the workpiece, the cutting blade is preliminarily made to cut into a dressing board (dress board) for the purpose of adjusting the shape of the cutting blade to a shape concentric with a spindle serving as a rotary shaft (shape adjustment, or circularity adjustment) or for the purpose of dissolving the loading or dulling or the like of the cutting edge (setting). As the dressing board, there is selected one that is suited to the kind of the cutting blade, the purpose of the conditioning (dressing) and the like. Therefore, a plurality of different dressing boards (for example, a dressing board for shape adjustment and a dressing board for setting) are often prepared for one kind of cutting blade.

Dressing of a cutting blade, in general, is performed while holding the dressing board by a general-purpose or dedicated chuck table. Therefore, for using different dressing boards, the dressing board held on the chuck table must be replaced. In connection with this problem, integration of two kinds of dressing boards by aligning them in a horizontal direction or the thickness direction has come to be investigated (see, for example, Japanese Patent Laid-Open No. 2006-218571 and Japanese Patent Laid-Open No. 2011-83840).

SUMMARY OF THE INVENTION

It is considered that the frequency of replacement of the dressing board can be lowered by the integration of two kinds of dressing boards, as disclosed in Japanese Patent Laid-Open Nos. 2006-218571 and 2011-83840. However, Japanese patent Laid-Open Nos. 2006-218571 and 2011-83840 only disclose a method of using an integrated dressing board in a limited situation.

It is therefore an object of the present invention to provide a novel method of using a laminated dressing board by which the frequency of replacement of dressing board can be lowered.

In accordance with one aspect of the present invention, there is provided a method of using a laminated dressing board in which a shape adjustment dressing layer containing first abrasive grains and used for shape adjustment of a cutting blade and a setting dressing layer containing second abrasive grains and used for setting of the shape-adjusted cutting blade are laminated. The method includes a holding step of holding the shape adjustment dressing layer side of the laminated dressing board by a chuck table, a setting dressing step of causing the cutting blade to cut into the laminated dressing board from the setting dressing layer side to form a first groove in the setting dressing layer, and a shape adjustment dressing step of causing the cutting blade to cut into a bottom of the first groove along the first groove to form a second groove in the shape adjustment dressing layer.

In the aforementioned aspect of the present invention, the method may further include a first shape adjustment dressing step of causing the cutting blade to cut into the laminated dressing board from the setting dressing layer side to form a third groove having such a depth as to reach the shape adjustment dressing layer, prior to the setting dressing step.

In accordance with another aspect of the present invention, there is provided a method of using a laminated dressing board in which a shape adjustment dressing layer containing first abrasive grains and used for shape adjustment of a cutting blade and a setting dressing layer containing second abrasive grains and used for setting of the shape-adjusted cutting blade are laminated. The method includes a holding step of holding the setting dressing layer side of the laminated dressing board by a chuck table, a shape adjustment dressing step of causing the cutting blade to cut into the laminated dressing board from the shape adjustment dressing layer side to form a first groove, and a setting dressing step of causing the cutting blade to cut into a bottom of the first groove along the first groove to form a second groove in the setting dressing layer.

In the aforementioned another aspect of the present invention, preferably, in the shape adjustment dressing step, the cutting blade is caused to cut into the laminated dressing board to such a depth that the setting dressing layer is exposed at the bottom of the first groove.

In the methods of using the laminated dressing board according to the aforementioned one aspect and another aspect, the shape adjustment dressing is performed by causing the cutting blade to cut into the shape adjustment dressing layer and the setting dressing is conducted by causing the cutting blade to cut into the setting dressing layer. Therefore, it is unnecessary to replace the dressing board at the time of switching between the shape adjustment dressing and the setting dressing. For this reason, according to the methods of using the laminated dressing board according to the aforementioned one aspect and another aspect of the present invention, the frequency of replacement of the dressing board can be lowered.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

An embodiment according to one aspect of the present invention will be described referring to the attached drawings. The method of using a laminated dressing board according to the present embodiment includes a holding step (see FIG. 3A or 3B), a setting dressing step (see FIG. 3A), and a shape adjustment dressing step (see FIG. 3B). In the holding step, a shape adjustment dressing layer side of a laminated dressing board in which the shape adjustment dressing layer used for shape adjustment of a cutting blade and a setting dressing layer used for setting of the cutting blade are laminated in the thickness direction is held by the chuck table. In the setting dressing step, the cutting blade is made to cut into the laminated dressing board from the setting dressing layer side to form a groove (first groove) in the setting dressing layer. In the shape adjustment dressing step, the cutting blade is made to cut into the bottom of the groove (first groove) formed in the setting dressing step, to form a groove (second groove) in the shape adjustment dressing layer. The method of using the laminated dressing board according to the present embodiment will be described in detail below.

Figure 1:
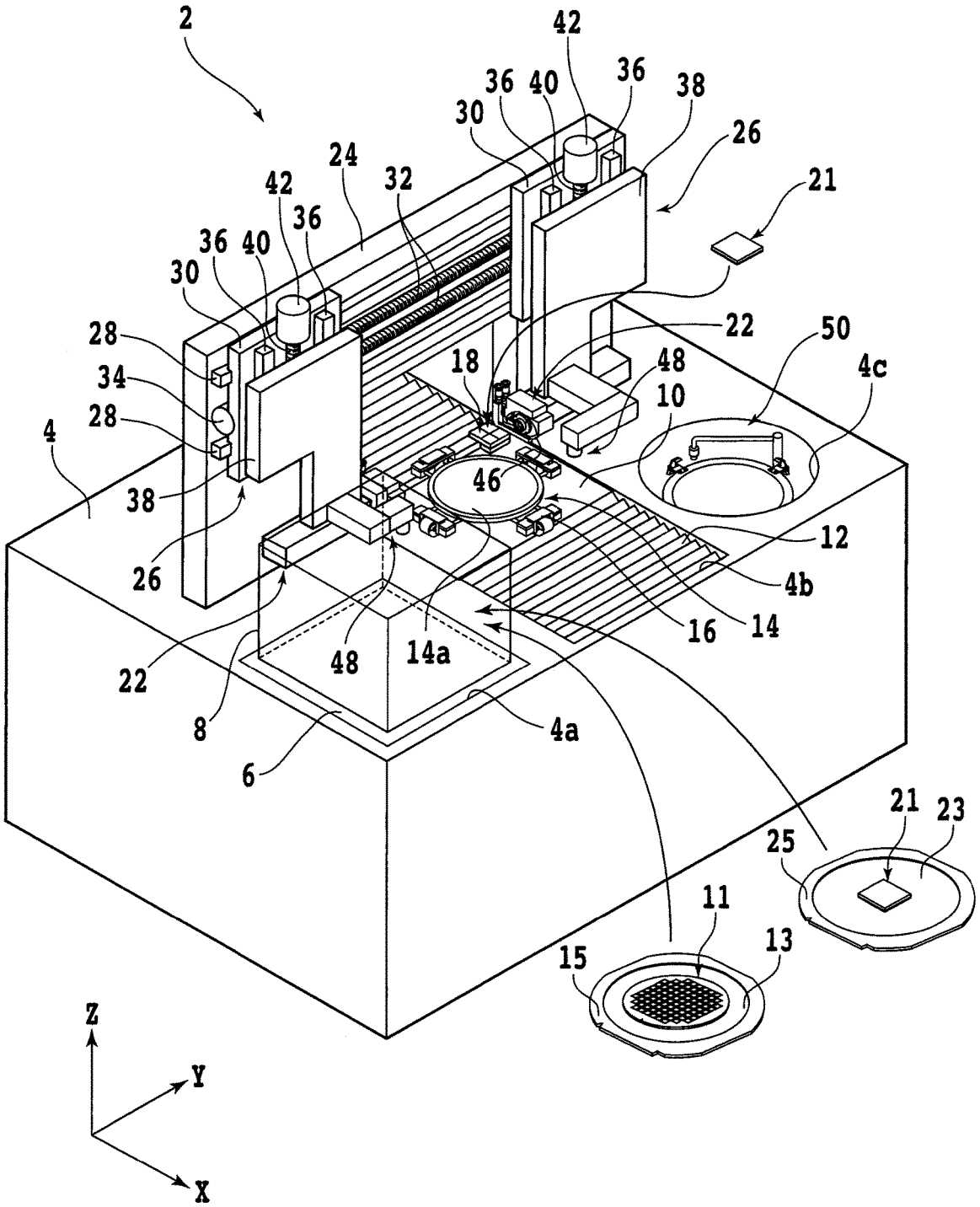
FIG. 1 is a perspective view depicting schematically a configuration example of a cutting apparatus.

First, a configuration example of a cutting apparatus and the like used in the method of using the laminated dressing board according to the present embodiment will be described. FIG. 1 is a perspective view depicting schematically a configuration example of a cutting apparatus 2 according to the present embodiment. As depicted in FIG. 1, the cutting apparatus 2 has a base 4 for supporting each structure. The base 4 is formed with a rectangular opening 4*a* in a corner portion on the front side thereof, and a cassette support base 6 which is lifted up and down by a lifting mechanism (not depicted) is provided in the opening 4*a*. A cassette 8 for accommodating a workpiece 11 or a laminated dressing board 21 is placed on an upper surface of the cassette support base 6. Note that only a contour of the cassette 8 is depicted in FIG. 1, for convenience of illustration. In addition, the laminated dressing board 21 may not necessarily be accommodated in the cassette 8.

The workpiece 11 is, for example, a disk-shaped wafer formed from a semiconductor material such as silicon. The front side of the workpiece 11 is partitioned into a plurality of regions by crossing division lines (streets), and a device such as an integrated circuit (IC) or micro electro mechanical systems (MEMS) is formed in each of the regions. A dicing tape 13 greater than the workpiece 11 in diameter is attached to the back side of the workpiece 11. An outer peripheral portion of the dicing tape 13 is fixed to an annular frame 15. In other words, the workpiece 11 is supported on the frame 15 through the dicing tape 13. Note that while a disk-shaped wafer formed of a semiconductor material such as silicon is used as the workpiece 11 in the present embodiment, the material, shape, structure and the like of the workpiece 11 are not limited. For example, a substrate formed of such a material as a ceramic, resin, metal or the like may be used as the workpiece 11. Similarly, the kind, number, layout and the like of the devices are not limited.

The laminated dressing board 21 is formed in a flat plate-like shape by binding abrasive grains of, for example, white alundum (WA) or green carborundum (GC) with a binder such as a resin, ceramic or the like. Note that the laminated dressing board 21 which is rectangular in plan-view shape is depicted as an example in the present embodiment, the material, shape, structure and the like of the laminated dressing board 21 are not limited. Details of the laminated dressing board 21 will be described later.

An opening 4*b* elongated in an X-axis direction (front-rear direction, or processing feed direction) is formed at a lateral side of the cassette support base 6. An X-axis moving table 10, an X-axis moving mechanism (not depicted) for moving the X-axis moving table 10 in the X-axis direction, and a dustproof and droplet-proof cover 12 for covering the X-axis moving mechanism are provided in the opening 4*b*. A first chuck table 14 for holding the workpiece 11 mainly is provided on the upper side of the X-axis moving table 10. The first chuck table 14 is connected to a rotational drive source (not depicted) such as a motor, and is rotated about a rotational axis which is substantially parallel to a Z-axis direction (vertical direction). In addition, the first chuck table 14 is moved in the X-axis direction (processing feed) by the aforementioned X-axis moving mechanism. An upper surface of the first chuck table 14 constitutes a holding surface 14*a* for holding the workpiece 11 thereon. The holding surface 14*a* is connected to a suction source (not depicted) through a suction passage 14*b* (see FIG. 3A, etc.) formed in the inside of the first chuck table 14. Besides, four clamps 16 for fixing the annular frame 15 supporting the workpiece 11 from four sides are arranged in the periphery of the first chuck table 14.

A second chuck table 18 for holding the laminated dressing board 21 is provided at a position adjacent to the first chuck table 14. The second chuck table 18 is connected to a suction source (not depicted) through a suction passage (not depicted) and the like, and is moved in the X-axis direction together with the first chuck table 14 and the clamps 16 and the like. Note that the laminated dressing board 21 can be held also by use of the first chuck table 14 and the clamps 16, in place of the second chuck table 18.

A carrying unit (not depicted) for carrying the aforementioned workpiece 11 and the like from the cassette 8 to the first chuck table 14 is provided in the vicinity of the opening 4*b*. The workpiece 11 carried by the carrying unit is placed on the holding surface 14*a* of the chuck table 14 in such a manner that, for example, the front side thereof is exposed to the upper side.

A gate-formed support structure 24 for supporting two sets of cutting units 22 is disposed on an upper surface of the base 4, in the manner of straddling the opening 4*b*. Two sets of cutting unit moving mechanisms 26 for moving each of the cutting units 22 in a Y-axis direction (left-right direction, or indexing feed direction) and the Z-axis direction are provided at upper portions of a front surface of the support structure 24. Each of the cutting unit moving mechanisms 26 has, in common, a pair of Y-axis guide rails 28 which are disposed on the front surface of the support structure 24 and are parallel to the Y-axis direction. A Y-axis moving plate 30 constituting each cutting unit moving mechanism 26 is slidably mounted to the Y-axis guide rails 28. Each Y-axis moving plate 30 is provided on the back side (rear side) thereof with a nut section (not depicted). A Y-axis ball screw 32 parallel to the Y-axis guide rails 28 is in screw engagement with the nut section. A Y-axis pulse motor 34 is connected to one end portion of each Y-axis ball screw 32. With the Y-axis ball screws 32 rotated by the Y-axis pulse motors 34, the Y-axis moving plates 30 are moved in the Y-axis direction along the Y-axis guide rails 28.

A pair of Z-axis guide rails 36 parallel to the Z-axis direction are provided on a surface (front surface) of each Y-axis moving plate 30. Z-axis moving plates 38 are slidably mounted to the Z-axis guide rails 36. Each Z-axis moving plate 38 is provided on the back side (rear side) thereof with a nut section (not depicted). A Z-axis ball screw 40 parallel to the Z-axis guide rails 36 is in screw engagement with the nut section. A Z-axis pulse motor 42 is connected to one end portion of each Z-axis ball screw 40. With the Z-axis ball screws 40 rotated by the Z-axis pulse motors 42, the Z-axis moving plates 38 are moved in the Z-axis direction along the Z-axis guide rails 36.

The cutting unit 22 is provided at a lower portion of each Z-axis moving plate 38. The cutting unit 22 has a circular annular cutting blade 46 mounted to one end side of a spindle 44 (see FIG. 3A, etc.) serving as a rotary shaft. In addition, a camera (imaging unit) 48 for imaging the workpiece 11 and the like is provided at a position adjacent to the cutting unit 22. With the Y-axis moving unit 30 moved in the Y-axis direction by each cutting unit moving mechanism 26, the cutting unit 22 and the camera 48 are moved in the Y-axis direction (indexing feed). In addition, with the Z-axis moving plate 38 moved in the Z-axis direction by each cutting unit moving mechanism 26, the cutting unit 22 and the camera 48 are lifted up or down.

A circular opening 4*c* is formed at a position on the opposite side of the opening 4*b* from the opening 4*a*. A cleaning unit 50 for cleaning the workpiece 11 having undergone cutting is provided in the opening 4*c*. A control unit (not depicted) is connected to the constituent elements such as the X-axis moving mechanism, the first chuck table 14, the clamps 16, the second chuck table 18, the cutting units 22, the cutting unit moving mechanisms 26, the cameras 48, and the cleaning unit 50. Each of the constituent elements is controlled by the control unit.

Figure 2A:
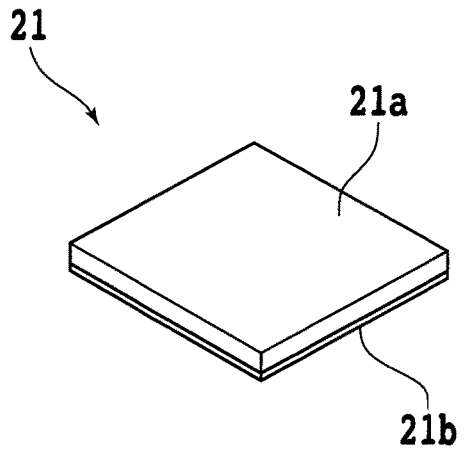
FIGS. 2A and 2B are perspective views depicting schematically a configuration example of a laminated dressing board.
Figure 2B:
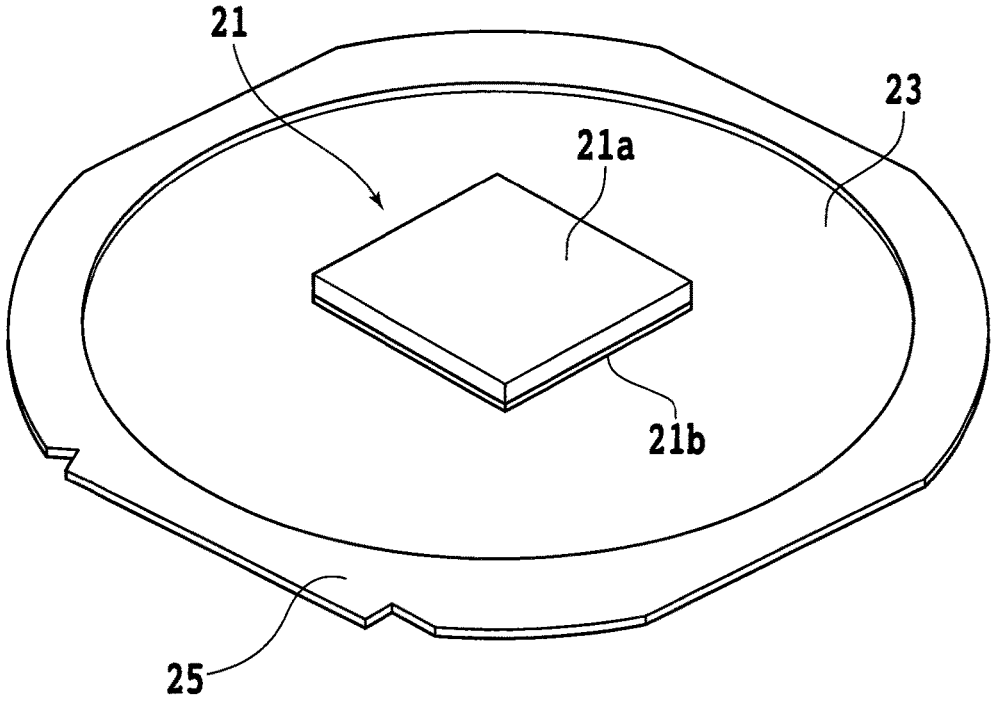

FIGS. 2A and 2B are perspective views depicting schematically a configuration example of the laminated dressing board 21. As depicted in FIGS. 2A and 2B, the laminated dressing board 21 includes a setting dressing layer 21*a* and a shape adjustment dressing layer 21*b* laminated in the thickness direction thereof. The setting dressing layer 21*a* is formed, for example, by mixing abrasive grains (second abrasive grains) of green carborundum (GC) or the like with a binder such as a resin or ceramic, and is suitable for setting for dissolving loading and/or dulling of the cutting blade 46. On the other hand, the shape adjustment dressing layer 21*b* is formed, for example, by mixing abrasive grains (first abrasive grains) of white alundum (WA) or the like with a binder such as a resin or ceramic, and is suitable for adjusting the shape of the cutting blade 46 to a shape concentric with the spindle 44 (circularity adjustment). The shape adjustment dressing layer 21*b* is higher than the setting dressing layer 21*a* in an effect of consuming the cutting blade. Therefore, in the case of making the cutting blade cut into the shape adjustment dressing layer 21*b*, it is unnecessary to make the cutting blade cut into the shape adjustment dressing layer 21*b* deeper as compared with the case of making the cutting blade cut into the setting dressing layer 21*a*. Accordingly, the shape adjustment dressing layer 21*b* is often formed to be thinner than the setting dressing layer 21*a*.

Specific thicknesses of the setting dressing layer 21*a* and the shape adjustment dressing layer 21*b* are determined according to the relationship between the cutting-in depth of the cutting blade 46 at the time of setting and the cutting-in depth of the cutting blade 46 at the time of shape adjustment. For example, the cutting-in depth of the cutting blade 46 at the time of setting is four to eight times, preferably five to six times, the cutting-in depth of the cutting blade 46 at the time of shape adjustment; according to this relation, the thicknesses of the setting dressing layer 21*a* and the shape adjustment dressing layer 21*b* can be determined.

In the method of using the laminated dressing board according to the present embodiment, first, a holding step is conducted in which the shape adjustment dressing layer 21*b* side of the laminated dressing board 21 is held so that the setting dressing layer 21*a* side is exposed to the upper side. While an example in which the laminated dressing board 21 is held by the first chuck table 14 is described in the present embodiment, the laminated dressing board 21 may be held by the second chuck able 18 for exclusive use. Note that in order to hold the shape adjustment dressing layer 21*b* side of the laminated dressing board 21 by the first chuck table 14, it is necessary to support the laminated dressing board 21 by the annular frame 25 through the dicing tape 23, as depicted in FIG. 2B. Specifically, the dicing tape 23 is preliminarily attached to the shape adjustment dressing layer 21*b* side of the laminated dressing board 21. In addition, the annular frame 25 is preliminarily fixed to an outer peripheral portion of the dicing tape 23. In the holding step, the dicing tape 23 attached to the laminated dressing board 21 is put in contact with the holding surface 14*a* of the first chuck table 14, and a negative pressure of the suction source is made to act thereon. In addition, the frame 25 is fixed by the clamps 16. As a result, the laminated dressing board 21 is held by the first chuck table 14 and the clamps 16, in a state in which the setting dressing layer 21*a* is exposed to the upper side (see FIG. 3A or 3B).

Figure 3A:
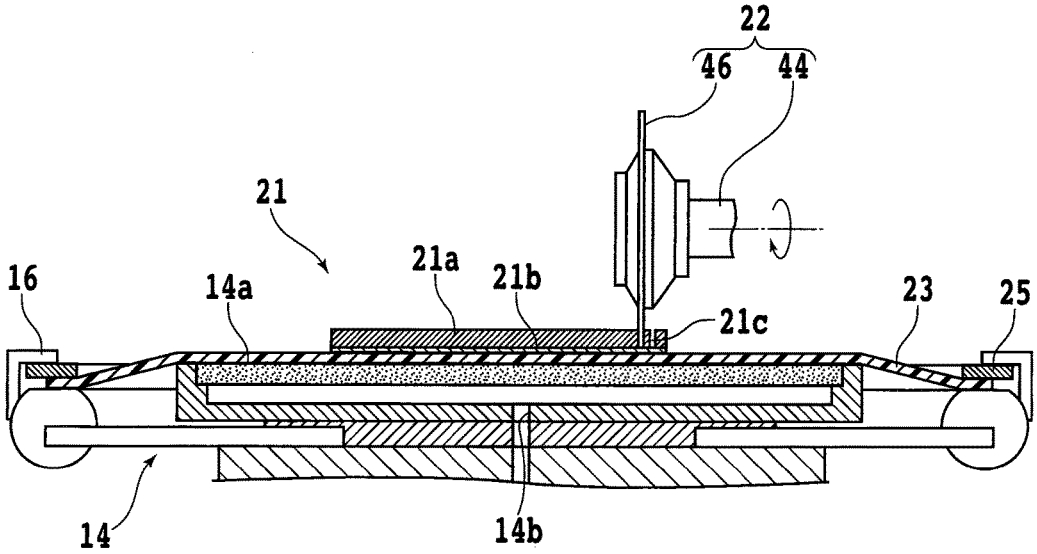
FIG. 3A is a partly sectional side view depicting schematically the manner in which a groove is formed in a laminated dressing board in a setting dressing step.

After the holding step, for example, a setting dressing step is performed in which the cutting blade 46 is made to cut into the laminated dressing board 21 from the side of the setting dressing layer 21*a* exposed to the upper side, to form a groove (first groove) in the setting dressing layer 21*a*. FIG. 3A is a partly sectional side view depicting schematically the manner in which the groove (first groove) 21*c* is formed in the laminated dressing board 21 in the setting dressing step. In the setting dressing step, first, the first chuck table 14 is rotated, to adjust the orientation of the laminated dressing board 21. In addition, the first chuck table 14 and the cutting unit 22 are moved relative to each other, to adjust the position of the cutting blade 46 relative to the laminated dressing board 21. Then, the lower end of the cutting blade 46 is moved to a position below the upper surface of the laminated dressing board 21 (namely, the upper surface of the setting dressing layer 21*a*) and above an interface between the setting dressing layer 21*a* and the shape adjustment dressing layer 21*b*. Thereafter, the first chuck table 14 is moved in the X-axis direction while rotating the cutting blade 46. Thus, it is possible to make the cutting blade 46 cut into the laminated dressing board 21 and thereby to form, in the setting dressing layer 21*a*, the groove 21*c* having such a depth as not to reach the shape adjustment dressing layer 21*b*. Since the abrasive grains (second abrasive grains) or the like suitable for setting of the cutting blade 46 are contained in the setting dressing layer 21*a* as aforementioned, the cutting blade 46 is set as the groove 21*c* is formed.

Figure 3B:
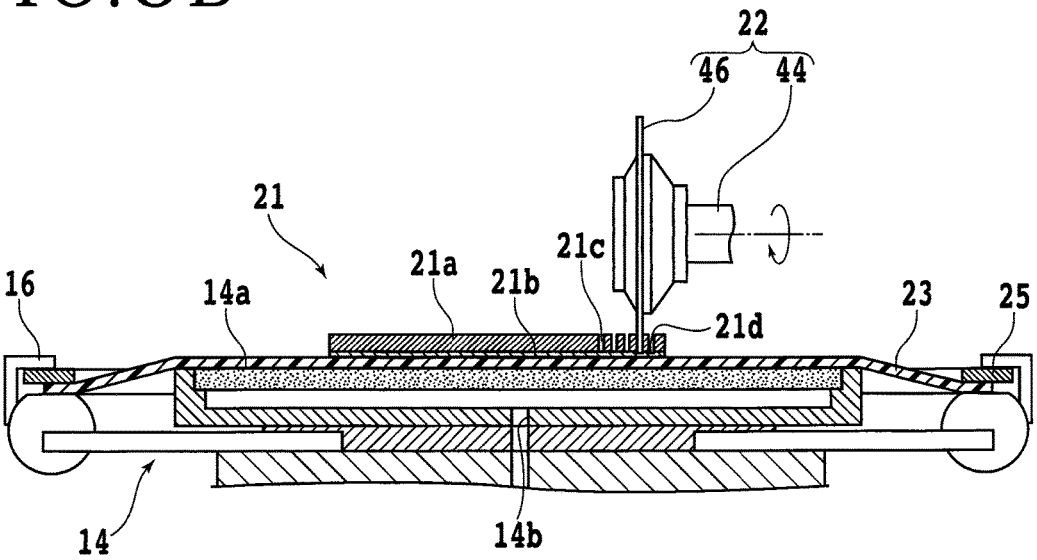
FIG. 3B is a partly sectional side view depicting schematically the manner in which a groove is formed in the laminated dressing board in a shape adjustment dressing step.

After the setting dressing step, for example, a shape adjustment dressing step is conducted in which the cutting blade 46 is made to cut into the bottom of the groove 21*c* formed in the setting dressing step, to form a groove (second groove) in the shape adjustment dressing layer 21*b*. FIG. 3B is a partly sectional side view depicting schematically the manner in which the groove (second groove) 21*d* is formed in the laminated dressing board 21 in the shape adjustment step. In the shape adjustment dressing step, first, the first chuck table 14 and the cutting unit 22 are moved relative to each other, to align the position of the cutting blade 46 onto an extension line of the groove 21*c*. Then, the lower end of the cutting blade 46 is moved to a position below the bottom of the groove 21*c* and above the lower surface of the laminated dressing board 21 (namely, the lower surface of the shape adjustment dressing layer 21*b*). Thereafter, the first chuck table 14 is moved in the X-axis direction while rotating the cutting blade 46. Thus, it is possible to make the cutting blade 46 cut into the bottom of the groove 21*c* along the groove 21*c* and thereby to form a groove 21*d* in the shape adjustment dressing layer 21*b*. Since the abrasive grains (first abrasive grains) or the like suitable for shape adjustment of the cutting blade 46 are contained in the shape adjustment dressing layer 21*b*, the cutting blade 46 is shape adjusted as the groove 21*d* is formed. Since the setting dressing layer 21*a* is more easily consumed than the shape adjustment dressing layer 21*b*, even if the setting dressing layer 21*a* is remaining at the bottom of the groove 21*c*, it has little influence on the shape adjustment dressing step.

Note that in the case where the shape adjustment dressing layer 21*b* side of the laminated dressing board 21 is held as in the present embodiment, it is recommendable to form the shape adjustment dressing layer 21*b* in a somewhat thick form, in order that the laminated dressing board 21 would not be split (broken up) when performing shape adjustment of the cutting blade 46. Specifically, the shape adjustment dressing layer 21*b* is formed to be thicker than the cutting-in depth of the cutting blade 46 into the shape adjustment dressing layer 21*b* at the time of shape adjustment by approximately 50 to 300 μm, preferably approximately 100 to 200 μm. For instance, in the case where the cutting-in depth of the cutting blade 46 into the shape adjustment dressing layer 21*b* at the time of shape adjustment is approximately 100 μm, the thickness of the shape adjustment dressing layer 21*b* is approximately 150 to 400 μm, preferably approximately 200 to 300 μm. With the thickness of the shape adjustment dressing layer 21*b* set with an allowance in this way, the laminated dressing board 21 is prevented from being split (broken up) at the time of performing shape adjustment of the cutting blade 46. Note that if the laminated dressing board 21 is split (broken up), the fragments may be scattered to collide against the cutting blade 46, possibly breaking the cutting blade 46. Where the thickness of the shape adjustment dressing layer 21*b* set with an allowance as aforementioned, therefore, it is possible to prevent scattering of fragments due to splitting of the laminated dressing board 21 and to prevent the cutting blade 46 from being broken. In addition, in this case, it is possible to set the interval between the adjacent grooves 21*c* (grooves 21*d*) to be sufficiently small, and thereby to use the laminated dressing board 21 efficiently.

On the other hand, the cutting-in depth of the cutting blade 46 into the setting dressing layer 21*a* at the time of setting is approximately four to eight times, preferably five to six times, the cutting-in depth of the cutting blade 46 into the shape adjustment dressing layer 21*b* at the time of shape adjustment. Therefore, in the case where the cutting-in depth of the cutting blade 46 into the shape adjustment dressing layer 21*b* at the time of shape adjustment is approximately 100 μm, the thickness of the setting dressing layer 21*a* is approximately 400 to 800 μm, preferably approximately 500 to 600 μm.

As has been described above, in the method of using the laminated dressing board according to the present embodiment, the cutting blade 46 is made to cut into the setting dressing layer 21*a* to perform setting dressing, and the cutting blade 46 is made to cut into the shape adjustment dressing layer 21*b* to perform shape adjustment dressing. Therefore, it is unnecessary to replace the dressing board at the time of switching between the setting dressing and the shape adjustment dressing. In short, it is possible to reduce the frequency of replacement of the dressing board.

Figure 4:
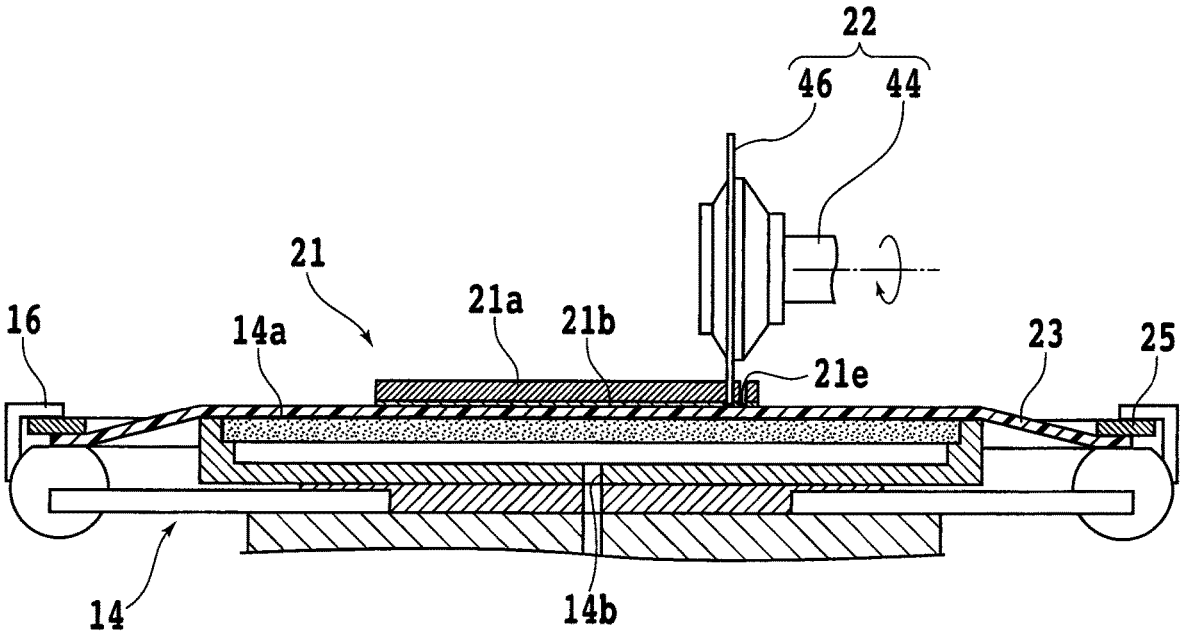
FIG. 4 is a partly sectional side view depicting schematically the manner in which a groove is formed in the laminated dressing board in a shape adjustment dressing step carried out prior to the setting dressing step.

Note that the present invention is not limited to or by the description of the above embodiment, and can be carried out with various modifications. For instance, while the shape adjustment dressing step is conducted after the setting dressing step in the above embodiment, the shape adjustment dressing step may be carried out before the setting dressing step. FIG. 4 is a partly sectional side view depicting schematically the manner in which a groove (second groove) 21*d* is formed in the laminated dressing board 21 in the shape adjustment dressing step performed before the setting dressing step. In the aforementioned shape adjustment dressing step (first shape adjustment dressing step) carried out before the setting dressing step, first, the first chuck table 14 is rotated, to adjust the orientation of the laminated dressing board 21. In addition, the first chuck table 14 and the cutting blade 22 are moved relative to each other, to adjust the position of the cutting blade 46 relative to the laminated dressing board 21. Then, the lower end of the cutting blade 46 is moved to a position below the interface between the setting dressing layer 21*a* and the shape adjustment dressing layer 21*b* and above the lower surface of the laminated dressing board 21 (namely, the lower surface of the shape adjustment dressing layer 21*b*). Thereafter, the first chuck table 14 is moved in the X-axis direction while rotating the cutting blade 46. Thus, the cutting blade 46 can be made to cut into the laminated dressing board 21, to form a groove (third groove) 21*e* having such a depth as to reach the shape adjustment dressing layer 21*b*. Since the abrasive grains (first abrasive grains) or the like suitable for shape adjustment of the cutting blade 46 are contained in the shape adjustment dressing layer 21*b* as aforementioned, the cutting blade 46 is shape adjusted as the groove 21*e* is formed. Since the setting dressing layer 21*a* is more easily consumed than the shape adjustment dressing layer 21*b*, even if the setting dressing layer 21*a* is remaining, it has little influence on the shape adjustment dressing step.

In addition, while the shape adjustment dressing layer 21*b* side of the laminated dressing board 21 is held by the first chuck table 14 in the above embodiment, the setting dressing layer 21*a* side may be held. In this modification, first, a holding step is conducted in which the setting dressing layer 21*a* side of the laminated dressing board 21 is held so that the shape adjustment dressing layer 21*b* side is exposed to the upper side. Note that a dicing tape 27 is preliminarily attached to the setting dressing layer 21*a* side of the laminated dressing board 21 (see FIG. 5A or 5B) so that the setting dressing layer 21*a* side of the laminated dressing board 21 can be held by the first chuck table 14. Besides, the annular frame 29 is preliminarily fixed to an outer peripheral portion of the dicing tape 27 (see FIG. 5A or 5B). In the holding step, the dicing tape 27 attached to the laminated dressing board 21 is put in contact with the holding surface 14*a* of the first chuck table 14, and a negative pressure of the suction source is made to act thereon. In addition, the frame 29 is fixed by the clamps 16. Thus, the laminated dressing board 21 is held by the first chuck table 14 and the clamps 16 in a state in which the shape adjustment dressing layer 21*b* is exposed to the upper side (see FIG. 5A or 5B).

Figure 5A:
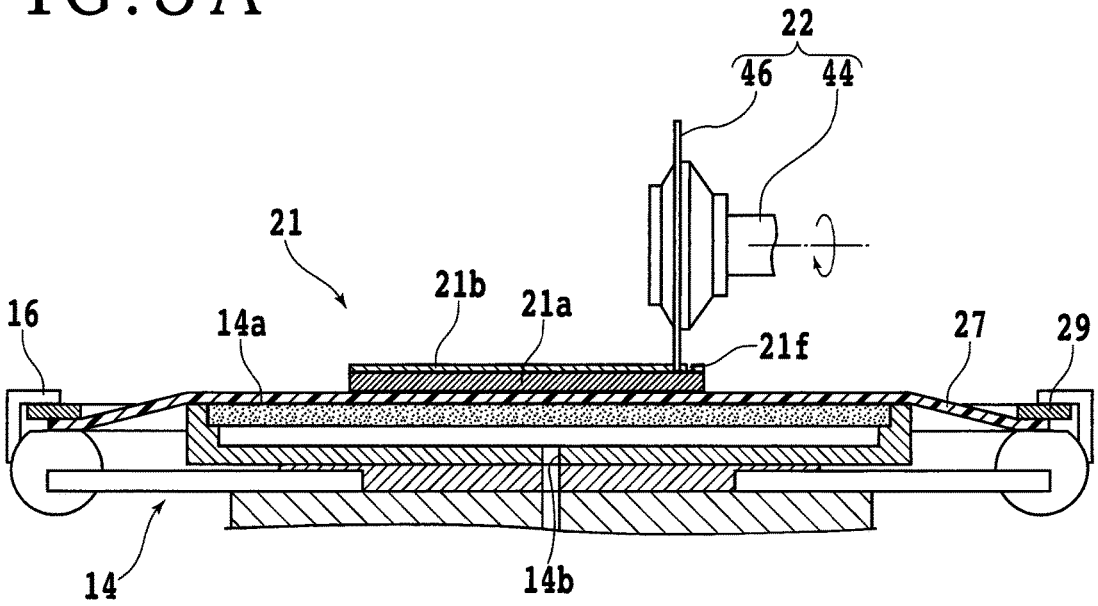
FIG. 5A is a partly sectional side view depicting schematically the manner in which a groove is formed in the laminated dressing board in a shape adjustment dressing step according to a modification.

After the holding step, for example, a shape adjustment dressing step is conducted in which the cutting blade 46 is made to cut into the laminated dressing board 21 from the side of the shape adjustment dressing layer 21*b* exposed to the upper side, to form a groove (first groove). FIG. 5A is a partly sectional side view depicting schematically the manner in which the groove (first groove) 21*f* is formed in the laminated dressing board 21 in the shape adjustment dressing step according to the modification. In the shape adjustment dressing step according to the modification, first, the first chuck table 14 is rotated, to adjust the orientation of the laminated dressing board 21. In addition, the first chuck table 14 and the cutting unit 22 are moved relative to each other, to adjust the position of the cutting blade 46 relative to the laminated dressing board 21. Then, the lower end of the cutting blade 46 is moved to a position below the upper surface of the laminated dressing board 21 (namely, the upper surface of the shape adjustment dressing layer 21*b*), preferably below the interface between the shape adjustment dressing layer 21*b* and the setting dressing layer 21*a*. Thereafter, the first chuck table 14 is moved in the X-axis direction while rotating the cutting blade 46. Thus, the cutting blade 46 can be made to cut into the laminated dressing board 21 to form the groove 21*f*. Since the abrasive grains (first abrasive grains) or the like suitable for shape adjustment of the cutting blade 46 are contained in the shape adjustment dressing layer 21*b* as aforementioned, the cutting blade 46 is shape adjusted as this groove 21*f* is formed.

Note that in the shape adjustment dressing step according to this modification, it is preferable to make the cutting blade 46 cut into the laminated dressing board 21 to such a depth that the setting dressing layer 21*a* is exposed at the bottom of the groove 21*f*. Since the shape adjustment dressing layer 21*b* is more difficultly consumed than the setting dressing layer 21*a*, in the case where the setting dressing layer 21*a* is not exposed at the bottom of the groove 21*f* the subsequent setting dressing step is liable to be influenced by the shape adjustment dressing layer 21*b* remaining in the groove 21*f*.

Figure 5B:
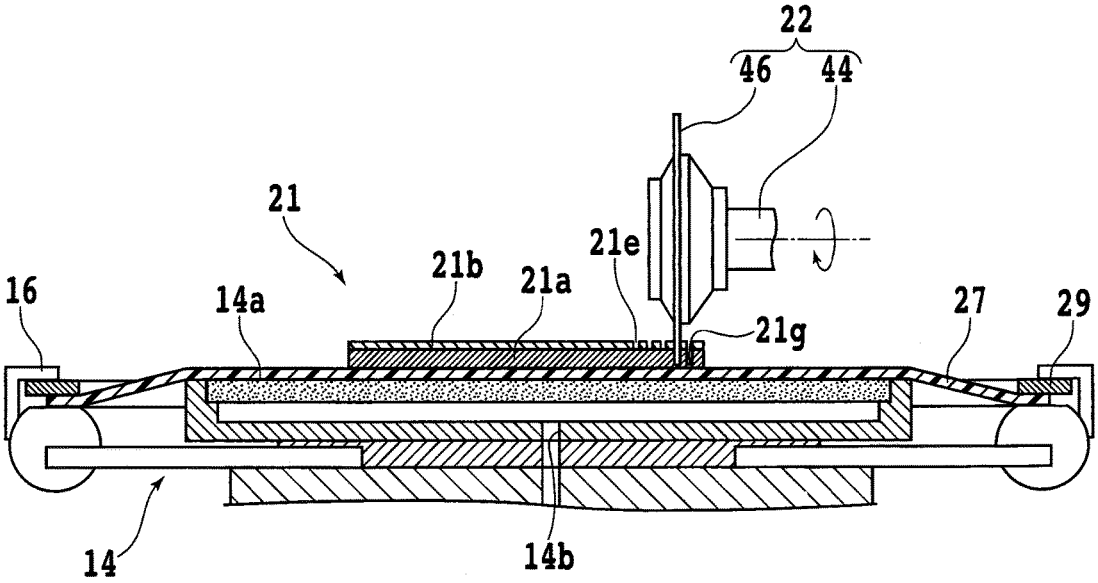
FIG. 5B is a partly sectional side view depicting schematically the manner in which a groove is formed in the laminated dressing board in a setting dressing step according to the modification.

After the shape adjustment dressing step according to the modification, for example, a setting dressing step is conducted in which the cutting blade 46 is made to cut into the bottom of the groove 21*f* formed in the shape adjustment dressing step, to form a groove (second groove) in the setting dressing layer 21*a*. FIG. 5B is a partly sectional side view depicting schematically the manner in which the groove (second groove) 21*g* is formed in the laminated dressing board 21 in the setting dressing step according to the modification. In the setting dressing step according to the modification, first, the first chuck table 14 and the cutting unit 22 are moved relative to each other, to adjust the position of the cutting blade 46 onto an extension line of the groove 21*f*. Then, the lower end of the cutting blade 46 is moved to a position below the bottom of the groove 21*f* and above the lower surface of the laminated dressing board 21 (namely, the lower surface of the setting dressing layer 21*a*). Thereafter, the first chuck table 14 is moved in the X-axis direction while rotating the cutting blade 46. Thus, the cutting blade 46 can be made to cut into the bottom of the groove 21*f* along the groove 21*f*, to form the groove 21*g* in the setting dressing layer 21*a*. Since the abrasive grains (second abrasive grains) or the like suitable for setting of the cutting blade 46 are contained in the setting dressing layer 21*a* as aforementioned, the cutting blade 46 is set as this groove 21*g* is formed.

Note that in the case where the setting dressing layer 21*a* side of the laminated dressing board 21 is held as in the modification, it is recommendable to form the setting dressing layer 21*a* in a somewhat thick form, in order that the laminated dressing board 21 would not be split (broken up) when setting the cutting blade 46. Specifically, the setting dressing layer 21*a* is formed to be thicker than the cutting-in depth of the cutting blade 46 into the setting dressing layer 21*a* at the time of setting by approximately 50 to 300 μm, preferably approximately 100 to 200 μm. For example, in the case where the cutting-in depth of the cutting blade 46 into the setting dressing layer 21*a* at the time of setting is approximately 500 μm, the thickness of the setting dressing layer 21*a* is approximately 550 to 800 μm, preferably approximately 600 to 700 μm. With the thickness of the setting dressing layer 21*a* set with an allowance in this way, the laminated dressing board 21 is prevented from being split (broken up) at the time of performing setting of the cutting blade 46.

In addition, in the above embodiment and the above modification, it is assumed that the number of times the cutting blade 46 is made to cut into the laminated dressing board 21 in the shape adjustment dressing step and the number of times the cutting blade 46 is made to cut into the laminated dressing board 21 at the time of the setting dressing step are substantially equal; however, the number of times of cutting-in in one of the two dressing steps may be greater than the number of times of cutting-in in the other of the two dressing steps. In such a case, it is recommendable to adjust the thickness of the setting dressing layer 21*a* or the shape adjustment dressing layer 21*b* according to the number of times the cutting blade 46 is made to cut in. For instance, where the number of times the cutting blade 46 is made to cut in in the shape adjustment dressing step is approximately two times the number of times the cutting blade 46 is made to cut in in the setting dressing step, the shape adjustment dressing layer 21*b* is made to be relatively thicker, taking this ratio into account. More specifically, for example, where the cutting-in depth of the cutting blade 46 into the shape adjustment dressing layer 21*b* is approximately 100 μm, the thickness of the shape adjustment dressing layer 21*b* is increased by 100 μm, whereby it is ensured that the cutting blade 46 can be made to cut twice into the position corresponding to one groove. In other words, the number of times the cutting blade 46 is made to cut in in the shape adjustment dressing step can be increased to two times the original number. Thus, by adjusting the thickness of the setting dressing layer 21*a* or the shape adjustment dressing layer 21*b* according to the number of times of cutting-in of the cutting blade, the laminated dressing board 21 as a whole can be used efficiently, cost can be reduced, and the frequency of replacement of the dressing board can be further lowered.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of using a laminated dressing board in which a shape adjustment dressing layer containing first abrasive grains and used for shape adjustment of a cutting blade and a setting dressing layer containing second abrasive grains and used for setting of the shape-adjusted cutting blade are laminated, the method comprising:

a holding step of holding the shape adjustment dressing layer side of the laminated dressing board by a chuck table;

a setting dressing step of causing the cutting blade to cut into the laminated dressing board from the setting dressing layer side to form a first groove in the setting dressing layer; and a shape adjustment dressing step of causing the cutting blade to cut into a bottom of the first groove along the first groove to form a second groove in the shape adjustment dressing layer, wherein the cutting blade used in the setting dressing step is the same cutting blade used in the shape adjustment dressing step.

2. The method of using the laminated dressing board according to claim 1, wherein:

said setting dressing step negates dulling of a cutting edge of the cutting blade; and said shape adjustment dressing step adjusts the shape of the cutting blade to a shape concentric with a rotary shape associated with the cutting blade.

3. The method of using the laminated dressing board according to claim 1, wherein:

said first abrasive grains of said shape adjustment dressing layer comprise white alundum; and said second abrasive grains of said setting dressing layer comprise green carborundum.

4. A method of using a laminated dressing board in which a shape adjustment dressing layer containing first abrasive grains and used for shape adjustment of a cutting blade and a setting dressing layer containing second abrasive grains and used for setting of the shape-adjusted cutting blade are laminated, the method comprising:

a holding step of holding the shape adjustment dressing layer side of the laminated dressing board by a chuck table;

a setting dressing step of causing the cutting blade to cut into the laminated dressing board from the setting dressing layer side to form a first groove in the setting dressing layer; and a shape adjustment dressing step of causing the cutting blade to cut into a bottom of the first groove along the first groove to form a second groove in the shape adjustment dressing layer, wherein the method further comprises a first shape adjustment dressing step of causing the cutting blade to cut into the laminated dressing board from the setting dressing layer side to form a third groove having such a depth as to reach the shape adjustment dressing layer, prior to the setting dressing step.

5. A method of using a laminated dressing board in which a shape adjustment dressing layer containing first abrasive grains and used for shape adjustment of a cutting blade and a setting dressing layer containing second abrasive grains and used for setting of the shape-adjusted cutting blade are laminated, the method comprising:

a holding step of holding the setting dressing layer side of the laminated dressing board by a chuck table;

a shape adjustment dressing step of causing the cutting blade to cut into the laminated dressing board from the shape adjustment dressing layer side to form a first groove; and a setting dressing step of causing the cutting blade to cut into a bottom of the first groove along the first groove to form a second groove in the setting dressing layer, wherein the cutting blade used in the setting dressing step is the same cutting blade used in the shape adjustment dressing step.

6. The method of using the laminated dressing board according to claim 5, wherein:

said shape adjustment dressing step adjusts the shape of the cutting blade to a shape concentric with a rotary shape associated with the cutting blade; and said setting dressing step negates dulling of a cutting edge of the cutting blade.

7. The method of using the laminated dressing board according to claim 5, wherein:

said first abrasive grains of said shape adjustment dressing layer comprise white alundum; and said second abrasive grains of said setting dressing layer comprise green carborundum.

8. A method of using a laminated dressing board in which a shape adjustment dressing layer containing first abrasive grains and used for shape adjustment of a cutting blade and a setting dressing layer containing second abrasive grains and used for setting of the shape-adjusted cutting blade are laminated, the method comprising:

a holding step of holding the setting dressing layer side of the laminated dressing board by a chuck table;

a shape adjustment dressing step of causing the cutting blade to cut into the laminated dressing board from the shape adjustment dressing layer side to form a first groove; and a setting dressing step of causing the cutting blade to cut into a bottom of the first groove along the first groove to form a second groove in the setting dressing layer, wherein in the shape adjustment dressing step, the cutting blade is caused to cut into the laminated dressing board to such a depth that the setting dressing layer is exposed at the bottom of the first groove.

* * * * *